US006045242A

United States Patent [19]

Wegrzyn et al.

[11] Patent Number: 6,045,242

[45] Date of Patent: Apr. 4, 2000

[54] LIGHTING FIXTURE

[75] Inventors: Joseph Wegrzyn, Stratford; Joseph M. LaRosa, Portland, both of Conn.

[73] Assignee: Dual-Lite Inc., Cheshire, Conn.

[21] Appl. No.: 09/107,887

[22] Filed: Jun. 30, 1998

[51] Int. Cl.[7] ..... F21V 21/00

[52] U.S. Cl. ..... 362/375; 362/404; 362/374

[58] Field of Search ..... 362/147, 404, 362/374, 375

[56] References Cited

U.S. PATENT DOCUMENTS

| | | | |
|---|---|---|---|
| D. 264,007 | 4/1982 | Heritage . | |
| D. 379,246 | 5/1997 | Haslam et al. . | |
| 3,702,928 | 11/1972 | Alger . | |
| 4,155,111 | 5/1979 | Kelly et al. | 362/374 |
| 4,302,798 | 11/1981 | Sit | 362/373 X |
| 4,460,947 | 7/1984 | Kelly | 362/374 |
| 4,751,627 | 6/1988 | Usher . | |
| 4,755,912 | 7/1988 | Evans . | |
| 4,827,386 | 5/1989 | Mackiewicz | 362/267 |
| 5,050,047 | 9/1991 | Viner et al. . | |
| 5,055,988 | 10/1991 | Cartwright . | |
| 5,446,634 | 8/1995 | Okubo | 362/362 X |
| 5,797,673 | 8/1998 | Logan et al. . | |

OTHER PUBLICATIONS

Liteforms Collection—LZ Series Emergency Lighting Units, Dual–Lite, Jun. 1997.

Liteforms Collection—LT Series Tandem Emergency Lighting Unit/Exit Signs, Dual–Lite, Jun. 1997.

*Primary Examiner*—Laura K. Tso

*Attorney, Agent, or Firm*—Ware, Fressola, Van der Sluys & Adolphson LLP

[57] ABSTRACT

An emergency lighting fixture comprises a housing which contains the lighting head with a light source such as a halogen lamp. The housing is positionable on its backplate in at least four different positions by use of mating slots and indexing members. The indexing members are mounted on extension members cantilevered from edges of the backplate. At least two screws are threadingly received in the extension members and engage the housing adjacent the slots to hold the housing and backplate in assembly.

21 Claims, 4 Drawing Sheets

20
42C
40C
8
54
56
10
9
48
42A
52
22
16
12
14
36
26
28
32
30
34
24
42D
38
18
42B

FIG. 5
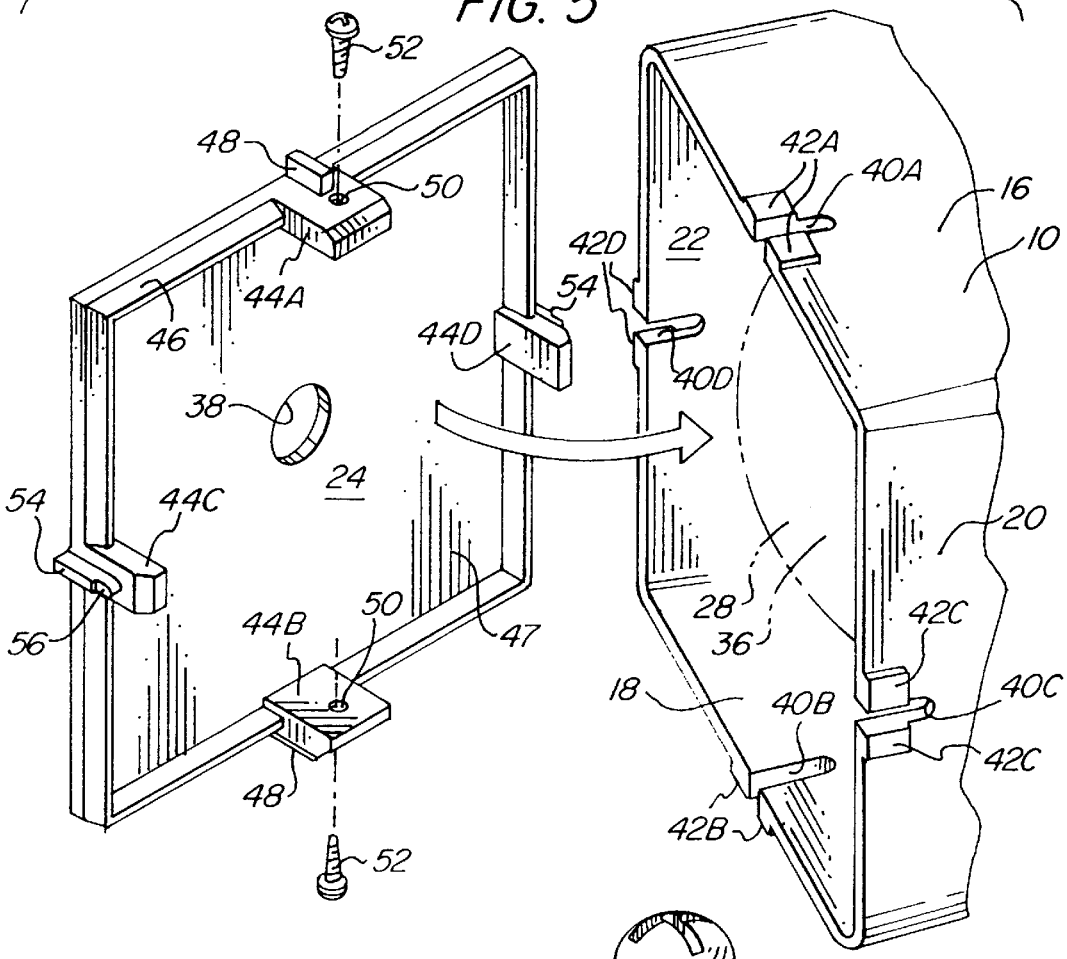
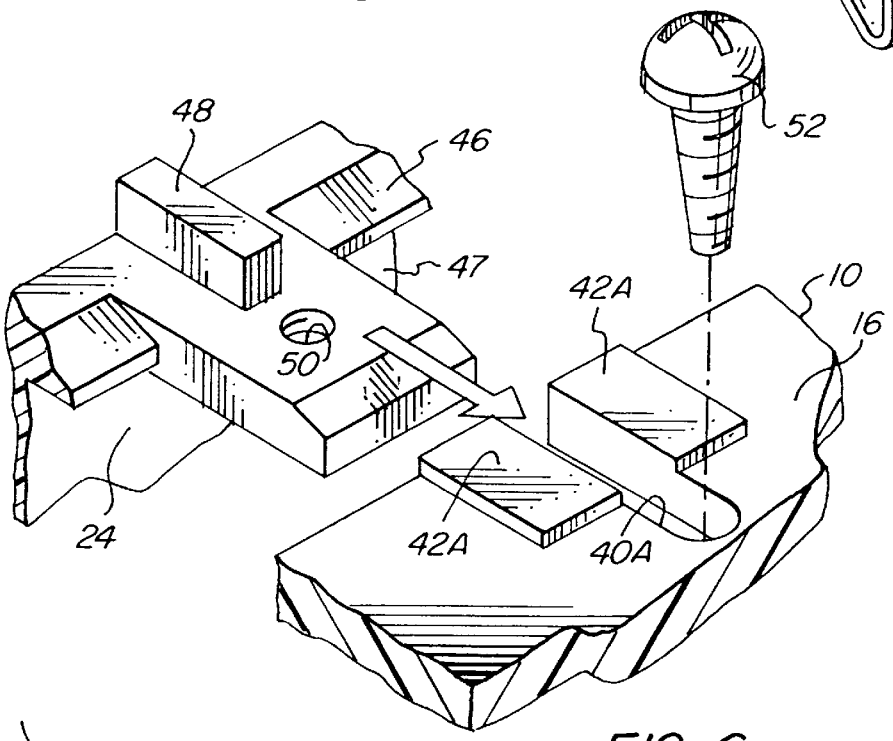
FIG. 6

LIGHTING FIXTURE

BACKGROUND OF THE INVENTION

1. Technical Field

The present invention relates generally to electrical lighting sources. More particularly, it relates to remote emergency electrical lighting fixtures.

2. Description of the Prior Art

Under current local fire and building codes, buildings to which the public has access are required to have emergency lighting devices. These devices must provide specific amounts of illumination and have emergency backup power sources to provide emergency illumination for a specified period of time during periods when utility power to the building is discontinued, thereby facilitating egress of persons from the building.

Traditionally, two incandescent lamps driven by a self-contained emergency battery power supply are used for illumination during power failure situations. A switching or transfer device will automatically operate the emergency illumination system when a power failure is detected.

While these traditional lighting arrangements perform adequately, they do have a few drawbacks. A major drawback is that the incandescent bulbs use large amounts of electrical power, thus requiring a relatively large emergency battery power supply for use during emergency lighting situations. Furthermore, while the incandescent bulbs provide adequate illumination, such bulbs do not have a long life in service and require frequent replacement.

SUMMARY OF THE INVENTION

It is an object of the present invention to provide a novel emergency lighting fixture using commercially available halogen lamps.

It is also an object to provide such a lighting fixture which allows the halogen lamps to be powered by a remotely located auxiliary emergency battery power supply and associated charging and transfer circuitry during emergency power situations.

Still another object is to provide such a lighting fixture in which the halogen lamps are arranged to provide the amount of illumination required by building codes.

Yet another object is to provide such a lighting fixture which allows the housing to be orientated in different positions relative to the backplate.

A further object is to provide such a lighting fixture which may be readily and economically fabricated and will enjoy a long life in operation.

The invention comprises an emergency lighting fixture in the form of a wedge-shaped housing attached to a backplate. The housing wall defines an opening through which partially extends a substantially spherical lighting head. The lighting head houses a light source such as, for example, a halogen lamp. The lighting head is rotatable within its opening to vary the direction of illumination provided by the light source. The housing and the backplate have cooperating slots and indexing members which permit the housing to be mounted on the backplate in one of four different positions.

The invention will be fully understood when reference is made to the following detailed description taken in conjunction with the drawings.

BRIEF DESCRIPTION OF THE DRAWINGS

FIG. 5 is an exploded perspective view of the lighting fixture of FIG. 1;

FIG. 6 is an enlarged exploded perspective view of the interconnection of FIG. 4;

BEST MODE FOR CARRYING OUT THE INVENTION

Figures 1, 2, 3, 4:
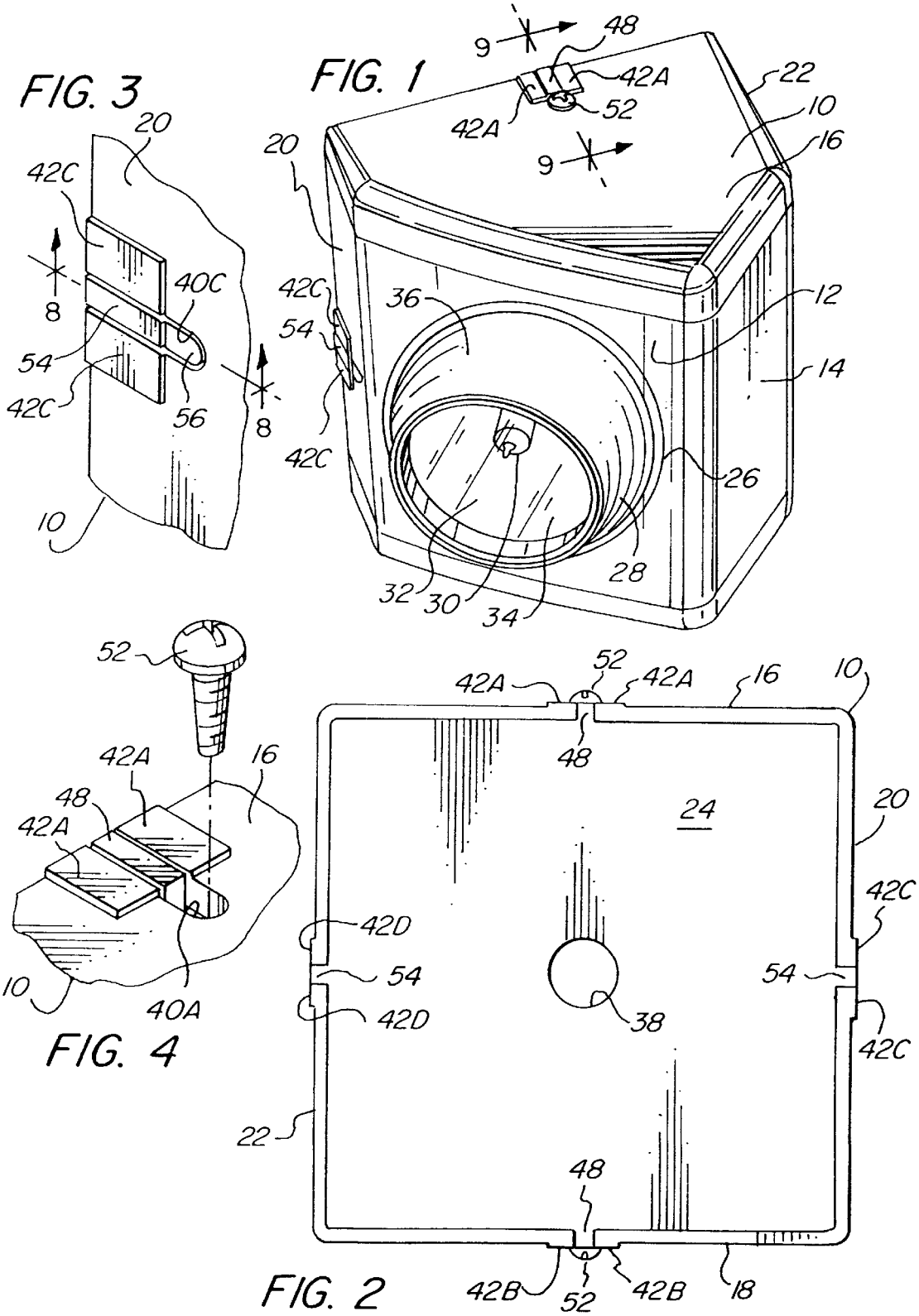
FIG. 1 is a perspective view of a lighting fixture in accordance with the present invention.
FIG. 2 is a rear view of the lighting fixture of FIG. 1.
FIG. 3 is an enlarged perspective view of one of the interconnections of the front housing member and the backplate in the lighting fixture of FIG. 1.
FIG. 4 is an enlarged perspective view of another one of the interconnections of the front housing member and the backplate in the lighting fixture of FIG. 1.
Figure 7:
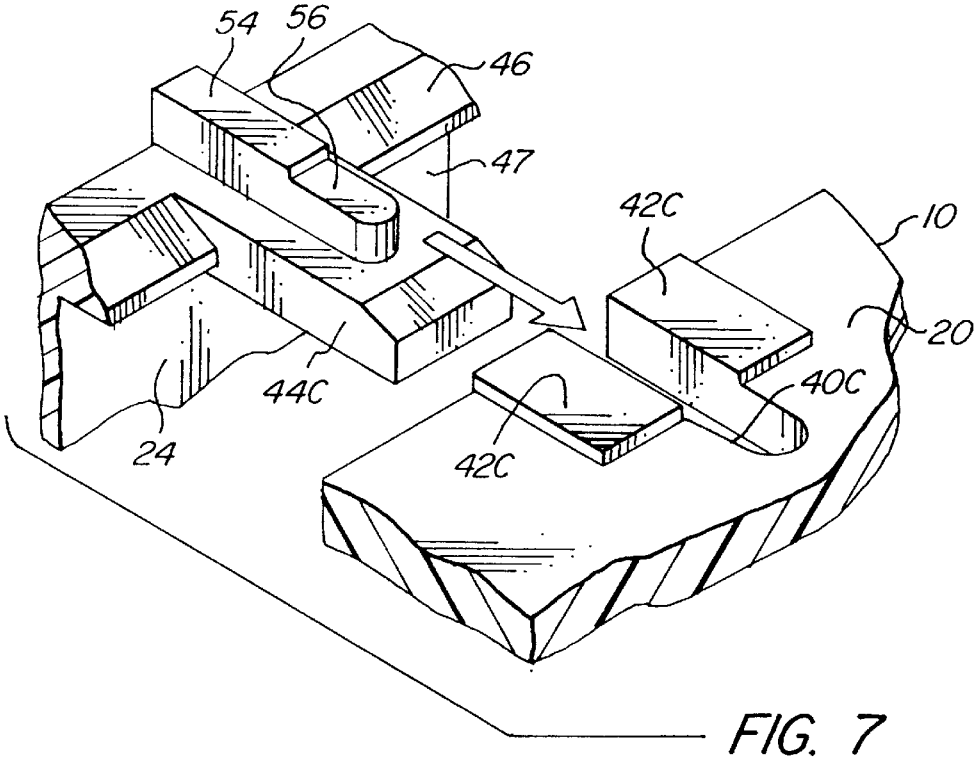
FIG. 7 is an enlarged exploded perspective view of the interconnection of FIG. 3.

With particular reference to FIGS. 1, 2 and 5, there is illustrated an emergency lighting fixture in accordance with the present invention. It comprises an integral wedge-shaped housing 10 having a curved major front wall 12, a minor front wall 14, a top wall 16, a bottom wall 18, a left sidewall 20 and a right sidewall 22. The housing 10 is closed by a square backplate 24 which is designed to be mounted by screws (not shown) against a flat surface such as a wall or ceiling in a manner well known to those skilled in the art.

The front wall 12 of the housing 10 of the lighting fixture of this invention defines a circular opening 26 through which partially extends a substantially spherical easily repositionable lighting head 28. The lighting head 28 and its mounting are identical to the lighting heads and mountings described in U.S. Ser. No. 08/888,155 filed Jul. 3, 1998 which is hereby incorporated by reference, particularly with reference to FIGS. 9 through 14 therein and the written description thereof. Accordingly, in view of this incorporation by reference, the lighting head 28 will be described herein in only a very general manner.

The lighting head 28 is designed to enclose a light source such as, for example, a halogen lamp. The lamp can be a commercially available halogen MR-16 lamp, rated at 6 volts, 5 watts. The lamp has a halogen bulb 30 centrally located in a parabolic reflector 32 which is covered by a transparent lens 34. The lamp is supported in a hemispherical shell 36 from the back of which pass the electrical wire conductors (not shown) for supplying power to the lamp. The electrical wire conductors extend through opening 38 (FIGS. 2 and 5) in the backplate 24 from which they go to a remotely located auxiliary emergency power source (not shown) in a well known manner. As will be appreciated by those skilled in the art, the auxiliary emergency power source would have an emergency battery power supply and associated charging and transfer circuitry to illuminate the halogen lamp during emergency power situations.

Figure 9:
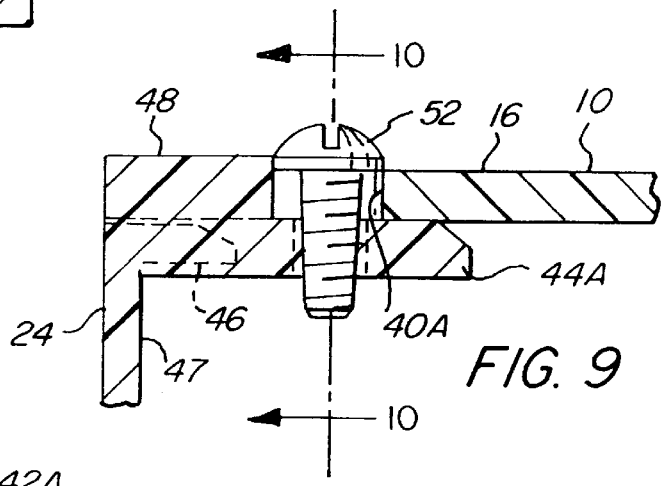
FIG. 9 is a cross-sectional view taken along the 9—9 line of FIG. 1.
Figure 10:
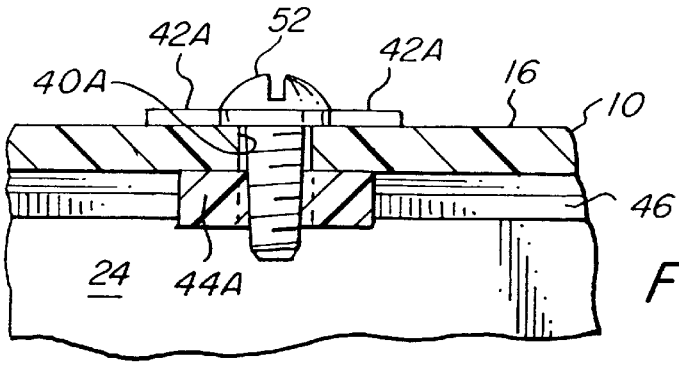
FIG. 10 is a cross-sectional view taken along the 10—10 line of FIG. 9.

FIG. 5 illustrates the housing 10 separated from the backplate 24. The housing 10 has four identical slots 40A, 40B,40C,40D extending respectively into a central portion of the top wall 16, bottom wall 18, left sidewall 20 and right sidewall 22, respectively. The exterior of these walls 16, 18, 20 and 22 have identical raised land portions 42A,42B,42C, 42D adjacent the slots 40A,40B,40C,40D. The backplate 24 has four extensions 44A,44B,44C,44D which extend from its chamfered edge 46 in a direction perpendicular to its major surface 47. The extensions 44A,44B are identical and the extension 44A is illustrated in detail in FIGS. 4, 6, 9 and 10. Each of the extensions 44A,44B includes an indexing member 48 dimensionally sized to fit within the slots 40A,40B,40C,40D so as to be flush with the land portions 42A,42B,42C,42D. A threaded opening 50 on each of the extensions 44A,44B receives a screw 52. As seen in FIGS. 9 and 10, when the housing 10 and the backplate 24 are assembled, the screw 52 extends through the housing 16 and is tightened to abut the land portion 42A holding the housing 10 and the backplate 24 in assembly. The screw 52 on the extension 44B is similarly positioned to abut land portion 42B.

Figure 8:
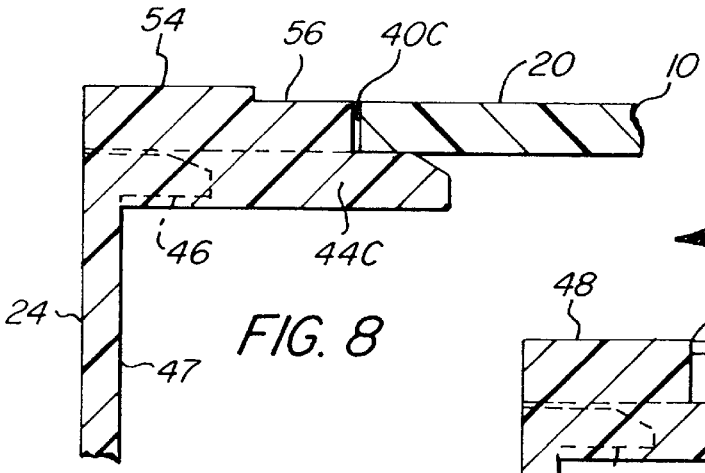
FIG. 8 is a cross-sectional view taken along the 8—8 line of FIG. 3.

With regard to the extensions 44C and 44D which are identical to each other, these both have indexing members 54 which are slightly longer than the indexing members 48 of the extensions 44A and 44B and are dimensionally sized to essentially fill the slots 40A,40B,40C,40D (see FIGS. 3 and 8). As also can be noted in FIGS. 3 and 8, an end portion 56 of each indexing element 54 is flush with the surrounding surface of its respective wall (16, 18, 20 or 22) when the housing 10 and the backplate 24 are assembled.

Figure 12:
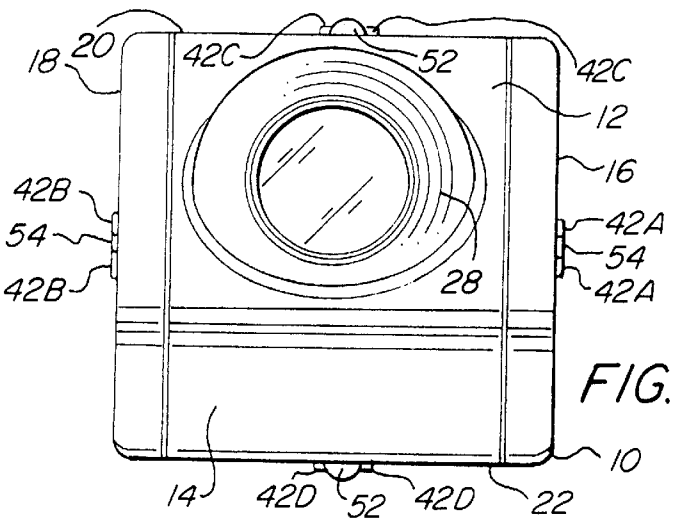
FIGS. 11 through 14 are front elevational views of the lighting fixture of FIG. 1 showing the various possible orientations of the housing member and the backplate.
Figure 11:
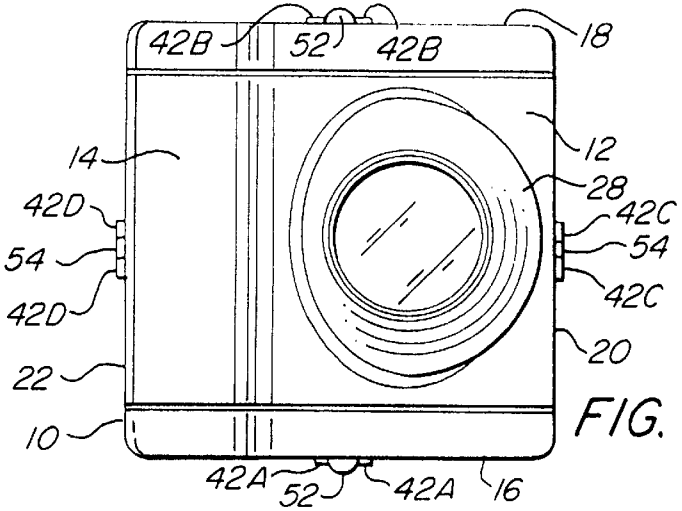
Figure 14:
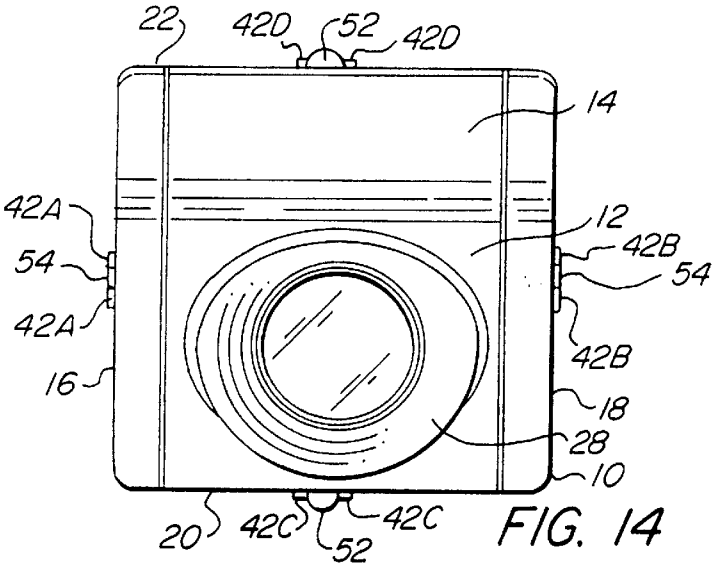
Figure 13:
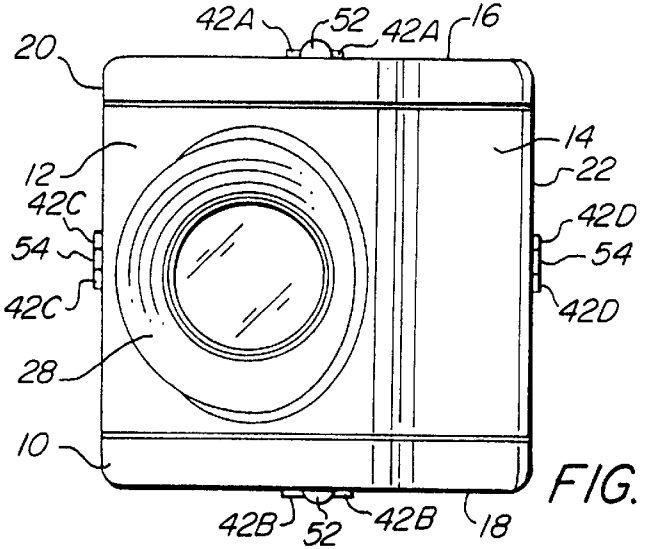

It will be appreciated by those skilled in the art that the housing 10 can be mounted on the backplate 24 in four different orientations because of the centrally located positions of the slots 40A,40B,40C,40D and the indexing members 48 and 54. These four different positions are shown in FIGS. 11 through 12. To change the orientation of the housing 10 relative to the backplate 24, the screws 52 are loosened and the housing 10 is pulled from the backplate 24 as shown in FIG. 5. The housing 10 can then be rotated in ninety degree (90) increments until it is in the desired new orientation at which time the housing 10 can be reinstalled on the backplate 24. The screws 52 are then tightened to complete the installation.

The housing 10 and backplate 24 may be constructed of flamerated, ultraviolet stable, ABS thermoplastic such as, for example, General Electric CYCOLAC®. If a halogen lamp is employed, the plastic for any parts in contact with the lamp, e.g., the hemispherical shell 36, should be resistant to its high heat and is preferably constructed of a flame-rated ultraviolet stable polycarbonate thermoplastic such as General Electric LEXAN® 80676.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

What is claimed is:

1. An emergency lighting fixture for providing emergency illumination during interruptions in utility power, the emergency lighting fixture comprising:

a housing defining an opening in a rear portion thereof;

a lighting head on said housing, said lighting head having a light source adapted to illuminate a region exterior of said housing in a direction of illumination, said lighting head is moveably retained in said housing to vary the direction of illumination;

a backplate adapted for mounting on a wall or ceiling and dimensionally sized to cover said opening of said housing; and indexing means for retaining said housing and said backplate in assembly in any one of at least four different positions.

2. The emergency lighting fixture of claim 1, wherein said indexing means comprises slots in one of said housing and said backplate and at least one indexing member in the other of said housing and said backplate, said at least one indexing member dimensionally sized to be received in said slots.

3. The emergency lighting fixture of claim 2, wherein said slots are in said housing and said at least one indexing member is on said backplate.

4. The emergency lighting fixture of claim 1, wherein said indexing means includes at least one screw engaging said housing for retaining said housing and said backplate in assembly.

5. The emergency lighting fixture of claim 4, wherein said at least one screw engages at least one raise land area on said housing to retain said housing and said backplate in assembly.

6. The emergency lighting fixture of claim 4, wherein each said at least one screw is threadingly received in an extension member of said backplate.

7. The emergency lighting fixture of claim 1, wherein said light source is a halogen lamp.

8. The emergency lighting fixture of claim 1, wherein said lighting fixture adjacent said light source is a heat-resistant plastic.

9. The emergency lighting fixture of claim 8, wherein said plastic is a flame-rated, ultraviolet stable, polycarbonate thermoplastic.

10. An emergency lighting fixture for providing emergency illumination during interruptions in utility power, the emergency lighting fixture comprising:

a housing defining an opening in a rear portion thereof;

a lighting head on said housing, said lighting head having a light source adapted to illuminate a region exterior of said housing;

a backplate adapted for mounting on a wall or ceiling and dimensionally sized to cover said opening of said housing; and indexing means for retaining said housing and said backplate in assembly in any one of at least four different positions, said indexing means includes at least one screw engaging said housing for retaining said housing and said backplate in assembly, each said at least one screw is threadingly received in an extension member of said backplate, each extension member is cantilevered in a substantially perpendicular direction from said backplate.

11. The emergency lighting fixture of claim 10, wherein said indexing means includes slots in said housing and at least one indexing member on said extension members of said backplate, each said at least on indexing member dimensionally sized to be received in said slots.

12. The emergency lighting fixture of claim 11, wherein each said at least one indexing member is flush with said housing when inserted in said slots.

13. The emergency lighting fixture of claim 12, wherein said housing includes at least one raised land area around said slots and each said at least one indexing member is flush with said at least one raised land area.

14. The emergency lighting fixture of claim 13, wherein said at least one screw engages said at least one raised land area to retain said housing and said backplate in assembly.

15. Emergency lighting fixture for providing emergency illumination during interruptions in utility power, the emergency lighting fixture comprising:

a housing defining an opening in a rear portion thereof;

a lighting head on said housing, said lighting head having a light source adapted to illuminate a region exterior of said housing;

a backplate adapted for mounting on a wall or ceiling and dimensionally sized to cover said opening of said housing, said backplate has four edges; and indexing means for retaining said housing and said backplate in assembly in any one of at least four different positions, said indexing means includes four extension members cantilevered from said edges in a direction perpendicular to a major surface of said backplate, said extension members being centrally located on said edges.

16. The emergency lighting fixture of claim 15, wherein said extension members have indexing members which fit into slots in said housing.

17. An emergency lighting fixture for providing emergency illumination during interruptions in utility power, the emergency lighting fixture comprising:

a housing defining an opening in a rear portion thereof;

a lighting head on said housing, said lighting head having a light source adapted to illuminate a region exterior of said housing, said lighting head is a spherical lighting head moveable retained in said housing to vary its direction of illumination;

a backplate adapted for mounting on a wall or ceiling and dimensionally sized to cover said opening of said housing; and indexing means for retaining said housing and said backplate in assembly in any one of at least four different positions.

18. An emergency lighting fixture for providing emergency illumination during interruptions in utility power, the emergency lighting fixture comprising:

a housing defining an opening in a rear portion thereof, said housing having at least six exterior walls which form a wedge shape;

a lighting head on said housing, said lighting head having a light source adapted to illuminate a region exterior of said housing;

a backplate adapted for mounting on a wall or ceiling and dimensionally sized to cover said opening of said housing; and indexing means for retaining said housing and said backplate in assembly in any one of at least four different positions.

19. An emergency lighting fixture for providing emergency illumination during interruptions in utility power, the emergency lighting fixture comprising:

a housing defining an opening in a rear portion thereof;

a lighting head on said housing, said lighting head having a light source adapted to illuminate a region exterior of said housing;

a backplate adapted for mounting on a wall or ceiling and dimensionally sized to cover said opening of said housing; and indexing means for retaining said housing and said backplate in assembly in any one of at least four different positions, said indexing means comprises slots in one of said housing and said backplate and at least one indexing member in the other of said housing and said backplate, said at least one indexing member dimensionally sized to be received in said slots, said slots are in said housing and said at least one indexing member is on said backplate, said at least one indexing member is flush with said housing when inserted in said slots.

20. The emergency lighting fixture of claim 19, wherein said housing includes at least one raised land area around said slots and said at least one indexing member is flush with said at least one raised land area.

21. The emergency lighting fixture of claim 20, wherein said indexing means includes at least one screw engaging said at least one raised land area to retain said housing and said backplate in assembly.

* * * * *